US011705635B2

(12) United States Patent
Mattox

(10) Patent No.: US 11,705,635 B2
(45) **Date of Patent: *Jul. 18, 2023**

(54) MULTIBAND CIRCULAR POLARIZED ANTENNA ARRANGEMENT

(71) Applicant: ACLARA TECHNOLOGIES LLC, St. Louis, MO (US)

(72) Inventor: Gary David Mattox, Bedford, OH (US)

(73) Assignee: Aclara Technologies LLC, St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/844,160

(22) Filed: Jun. 20, 2022

(65) Prior Publication Data

US 2022/0328963 A1 Oct. 13, 2022

Related U.S. Application Data

(63) Continuation of application No. 16/875,714, filed on May 15, 2020, now Pat. No. 11,367,956.

(60) Provisional application No. 62/849,416, filed on May 17, 2019.

(51) Int. Cl.

| | |
|---|---|
| ***H01Q 5/385*** | (2015.01) |
| ***H01Q 1/48*** | (2006.01) |
| ***H01Q 1/24*** | (2006.01) |

(52) U.S. Cl.

CPC ..... *H01Q 5/385* (2015.01); *H01Q 1/24* (2013.01); *H01Q 1/48* (2013.01)

(58) Field of Classification Search

CPC ..... H01Q 5/385; H01Q 1/24; H01Q 1/48
USPC ..... 343/846
See application file for complete search history.

(56) References Cited

U.S. PATENT DOCUMENTS

| | | | | |
|---|---|---|---|---|
| 6,304,219 | B1 | 10/2001 | Rothe | |
| 8,077,116 | B2 * | 12/2011 | Shamblin | H01Q 5/321 343/895 |
| 9,466,885 | B1 | 10/2016 | Farmahini Farahani et al. | |
| 10,276,939 | B1 | 4/2019 | Webb et al. | |
| 10,916,860 | B2 * | 2/2021 | Tarng | H01Q 1/48 |
| 2005/0168384 | A1 | 8/2005 | Wang et al. | |
| 2008/0074283 | A1 * | 3/2008 | Verkleeren | H01Q 1/2233 340/870.02 |
| 2008/0258979 | A1 | 10/2008 | Lin et al. | |
| 2010/0000297 | A1 | 1/2010 | Jones | |
| 2011/0012800 | A1 | 1/2011 | Shamblin et al. | |
| 2013/0013228 | A1 | 1/2013 | Genta | |
| 2016/0164168 | A1 | 6/2016 | Choi et al. | |

(Continued)

OTHER PUBLICATIONS

PCT/US2020/033229 International Search Report and Written Opinion dated Oct. 5, 2020.

(Continued)

*Primary Examiner* — Hai V Tran
(74) *Attorney, Agent, or Firm* — Robinson & Cole LLP

(57) ABSTRACT

A circularly polarized, multiband, and wideband antenna and can communicate with a GPS system. The antenna may include a driving element, first, second and third conductive parasitic elements electrically connected to the driving element, and a ground plane. The parasitic elements are provided with different lengths to provide for wider band operation with multiple resonant frequencies. The radiated wave has a low angle of propagation and travels for at least 1-2 miles.

20 Claims, 6 Drawing Sheets

(56) References Cited

U.S. PATENT DOCUMENTS

| | | | | |
|---|---|---|---|---|
| 2016/0172750 | A1* | 6/2016 | Ng | H01Q 9/0421 343/841 |
| 2017/0077598 | A1 | 3/2017 | Foore et al. | |
| 2018/0097277 | A1 | 4/2018 | Koga | |
| 2019/0214723 | A1 | 7/2019 | Zhang et al. | |
| 2020/0271240 | A1 | 8/2020 | Kuhn et al. | |

OTHER PUBLICATIONS

The extended European Search Report dated May 2, 2023, by the European Patent Office in corresponding European Patent Application No. 20808986.2. (10 pages).

* cited by examiner

MULTIBAND CIRCULAR POLARIZED ANTENNA ARRANGEMENT

CROSS-REFERENCE TO RELATED APPLICATIONS

This application claims priority to U.S. Provisional Patent Application No. 62/849,416, filed May 17, 2019 and U.S. patent application Ser. No. 16/875,714, filed May 15, 2020, the entire contents of which are incorporated by reference herein.

FIELD

The present disclosure relates, generally, to an antenna for communicating time-correlated acoustic sensor data. In particular, but not exclusively, the present disclosure relates to a novel antenna arrangement associated with an acoustic sensor system for remotely transmitting readings from the acoustic sensor from a generally underground pit box to a remote receiver.

BACKGROUND

In an effort to alleviate wasteful and costly problems associated with the detection of water leaks, the present disclosure provides a uniquely configured antenna arrangement (e.g., in an arrangement that loosely resembles the shape of a hand and, thus, may be referred to herein as a 'hand antenna') for transmitting collected, or logged, acoustic sensor data via signals generated by a sensor transmission unit (STU). In general, with respect to exemplary embodiments of the disclosure the antenna arrangement is connected to the sensor transmission unit which, in turn, is connected to the acoustic sensor/logger. The acoustic sensor detects acoustic signals associated with the flow of water through a water main or other pipe and provides the logged data to the transmission unit. The transmission unit formats the sensor data into data packets, including, for example, time of day (TOD) data and location data, which are provided by a global positioning satellite (GPS). The data is then transmitted via the antenna using radio frequency (RF) signals. The transmission unit often transmits the formatted data to a central reading station, or a data collector unit (DCU), where it is correlated with similar data from other transmission units and acoustic loggers located elsewhere on the water network. In some instances the radio frequency signal may be transmitted over relatively long distances, such as a mile or more. Thus, the remote transmission units may require a robust antenna capable of wirelessly transmitting the sensor data the necessary distances with minimal data corruption or interference.

The amount of radio frequency energy actually irradiated into the airspace as compared with that which is intended to be irradiated is a function of a number of factors. Such factors may include the applied voltage, the amount of current flowing through the antenna, the frequency of the signal applied to the antenna, the material from which the antenna is made, the geometry of such antenna, the angle of transmission, and the materials that are in a relatively close surrounding space of the antenna (such as within a sphere-radius measuring up to a few wavelengths of the radio signal applied to such antenna). When the surroundings of the antenna vary, the antenna performance (i.e., the degree of the radiated energy therefrom) will also tend to vary correspondingly.

Thus, various factors were considered in designing and successfully deploying an integrated antenna system in accordance with the disclosure. Some of these conditions or factors may include, frequency of operation, transmitter output power, antenna gain, antenna polarization, antenna pattern, azimuth beam-width, azimuth variation, government regulations for operating radio equipment, characteristic antenna impedance, coefficient of maximum wave reflection, antenna geometry, antenna location, ability to effect installation, length of service life desired, ability to operate in exposed environmental conditions such as exposure to water with only very small variation in operation performance due to any water absorption into the antenna system, ultra-violet resistance, shock and vibration resistance, and environmental temperature variability resistance. In addition, consideration of cost and manufacturability factors associated with a large volume of such units, e.g., for use in a full system having a large number of sensor locations throughout a water transmission system) with reliability and repeatability of performance. One or more of the above-mentioned parameters and conditions were contemplated to achieve the exemplary embodiments described herein and described in detail below.

SUMMARY

According to one aspect, an antenna arrangement is provided for transmitting measured acoustic data. The antenna arrangement includes a substrate and a ground plane. The antenna further includes a driving element proximate to the substrate and electrically connected to the ground plane. The driving element includes a feed point for receiving an input current signal. The antenna arrangement also includes a first parasitic element electrically connected to the driving element. The antenna arrangement also includes a second parasitic element longer than the first parasitic element and electrically connected to the driving element. The antenna arrangement also includes a third parasitic element shorter than the second parasitic element and electrically connected to the second parasitic element. The antenna arrangement also includes a fourth parasitic element electrically separated from the first, second, and third parasitic elements.

In another aspect, the first parasitic element is electrically connected to the driving element via a first shorting bar, the second parasitic element is electrically connected to the driving element via a second shorting bar, and the third parasitic element is electrically connected to the driving element via a third shorting bar.

In another aspect, wherein the third parasitic element is located on the opposite side of the driving element from the second parasitic element.

In another aspect, the antenna arrangement further includes a non-conductive first parasitic gap disposed between the first parasitic element and the driving element, a non-conductive second parasitic gap disposed between the second parasitic element and the driving element, and a non-conductive third parasitic gap disposed between the second parasitic element and the third parasitic element.

In another aspect, an electromagnetic wave radiated from the antenna arrangement is circularly polarized.

In another aspect, the first parasitic element and the second parasitic element are positioned on either side of the driving element.

In another aspect, the first parasitic element and the second parasitic element are positioned parallel to the driving element.

In another aspect, the antenna is configured to operate in temperatures in the range of −40° C. to 80° C.

In another aspect, the antenna arrangement is configured to have a multi-resonant response from 450 MHz to 470 MHz.

According to one aspect, a pit lid for providing a seal at a top of a valve chamber. The pit lid includes an antenna assembly. The antenna assembly includes a substrate and a ground plane. The antenna assembly further includes a driving element proximate to the substrate and electrically connected to the ground plane. The driving element includes a feed point for receiving an input current signal. The substrate includes a first parasitic element electrically connected to the driving element. The antenna arrangement also includes a second parasitic element longer than the first parasitic element and electrically connected to the driving element. The antenna arrangement also includes a third parasitic element shorter than the second parasitic element and electrically connected to the second parasitic element. The antenna arrangement also includes a fourth parasitic element electrically separated from the first, second, and third parasitic elements.

In another aspect, the antenna assembly is configured to receive a signal from a global positioning system (GPS) satellite.

In another aspect, the antenna arrangement is configured to have a multi-resonant response from 450 Megahertz (MHz) to 470 MHz.

In another aspect, the antenna arrangement also includes a non-conductive first parasitic gap disposed between the first parasitic element and the driving element, a non-conductive second parasitic gap disposed between the second parasitic element and the driving element, and a non-conductive third parasitic gap disposed between the second parasitic element and the third parasitic element.

In another aspect, an electromagnetic wave radiated from the antenna arrangement is circularly polarized.

In another aspect, the antenna arrangement and ground plane are separated by standoffs.

According to one aspect, a communication system is provided, the communication system includes an antenna assembly, a communication assembly, and a pit lid. The communication assembly include a sensor transmission unit communicatively connected to an acoustic sensor and the antenna assembly. The antenna assembly is mechanically coupled to the pit lid and positioned between the pit lid and a pipe. The acoustic sensor is physically coupled to a valve stem within the valve chamber.

In another aspect, the pit lid is configured to provide a seal at a top of a valve chamber within the pipe.

In another aspect, the communication assembly is configured to transmit data collected by the sensor to a remote data collection unit via the antenna assembly.

In another aspect, the antenna arrangement includes a substrate, a ground plane, and a driving element proximate the substrate and electrically connected to the ground plane. The driving element includes a feed point for receiving an input current signal. The antenna arrangement also includes a first parasitic element electrically connected to the driving element, and a second parasitic element longer than the first parasitic element and electrically connected to a driving element. The antenna arrangement also include a third parasitic element shorter than the second parasitic element and electrically connected to the second parasitic element, and a fourth parasitic element electrically separated from the first, second and third parasitic elements.

In another aspect, the first, second, third, and fourth parasitic elements have different lengths from one another.

An antenna in accordance with one or more aspects of the disclosed embodiments radiates at a low horizontal angle in a valve stack pipe made of metallic or non-metallic material. According to even further embodiments the antenna is multiband and extra-wide band operating in the FCC-licensed frequency range of 450 MHz to 470 MHz. According to these and other embodiments the antenna operates with GPS signals to provide correlated time and location data.

In accordance with further aspects an exemplary antenna is IP67 compliant (e.g., the antenna is protected from dust and is protected from the effects of being immersed in water to a depth between 15 cm and 1.0 meter for at least thirty minutes). Additionally, the antenna according to exemplary embodiments can operate in temperatures from −40 degrees Celsius to +80 degrees Celsius and can radiate at least 2 miles. According to a further aspect of an exemplary embodiment the antenna is about 5.75 inches in diameter and can be mounted under and attached to a valve stack lid in a water distribution network.

Other objects and features are either expressly disclosed or will become apparent to those of ordinary skill.

BRIEF DESCRIPTION OF THE DRAWINGS AND APPENDIX

Corresponding reference characters indicate corresponding parts throughout the drawings.

DETAILED DESCRIPTION

Figure 1:
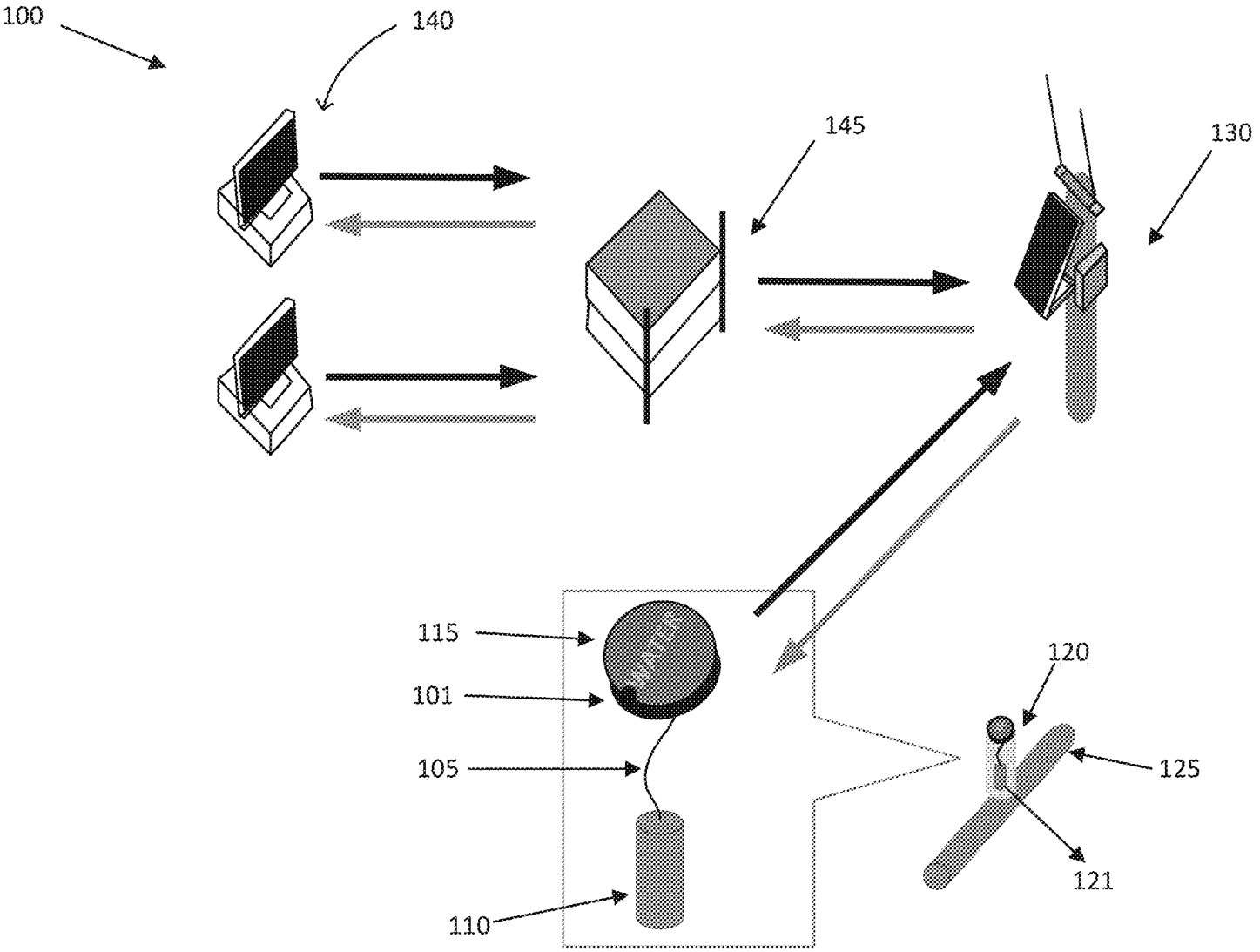
FIG. 1 is a system diagram showing components of an exemplary overall leak detection system deploying an antenna arrangement in accordance with one or more aspects of the present disclosure.

FIG. 1 is system diagram illustrating an exemplary environment where an antenna in accordance with one or more embodiments may be deployed. As shown, system 100 includes a communication assembly 101 which includes a sensor transmission unit (STU) 105 communicatively connected to an acoustic sensor/logger 110 and a pit lid/antenna 115. Pit lid/antenna 115 includes an antenna (not shown), which is described in more detail below and provides a seal at the top of valve chamber 120. According to the exemplary embodiment shown, communication assembly 101 is deployed within valve chamber 120 which is, in turn, connected to water main 125. Acoustic sensor 110 is magnetically attached to valve stem 121 within valve chamber 120.

In one embodiment, the pit lid/antenna 115 is also configured to receive signals from one or more global positioning system (GPS) satellites. The signals may be processed by the communication assembly 101, and can provide position, date and time information to the system.

Data collector unit (DCU) 130, which is positioned up to one or more miles away from the valve chamber 120, initiates a data collection routine by sending RF signals to the STU 105 at a predetermined time. For example, the data collection routine may be initiated during very early hours of the morning when ambient noise in the area surrounding the valve chamber 120 and, thus, the pit lid/antenna 115, are minimal. STU 105, upon receiving the data collection request from DCU 130, sends acoustic data collected by acoustic sensor 110 to DCU 130 via RF signals from the antenna. The data from STU 105 is then correlated with other such data from other STUs, e.g., in a water distribution network, and provided to end users 140 via a network control computer (NCC) 145 for analysis and processing.

The STU 105 may format data, such as sensor data received from the acoustic sensor 110, into data packets. The data packets may include time of day (TOD) data and location data, which may be provided by GPS satellites, in addition to sensor data.

Figure 2:
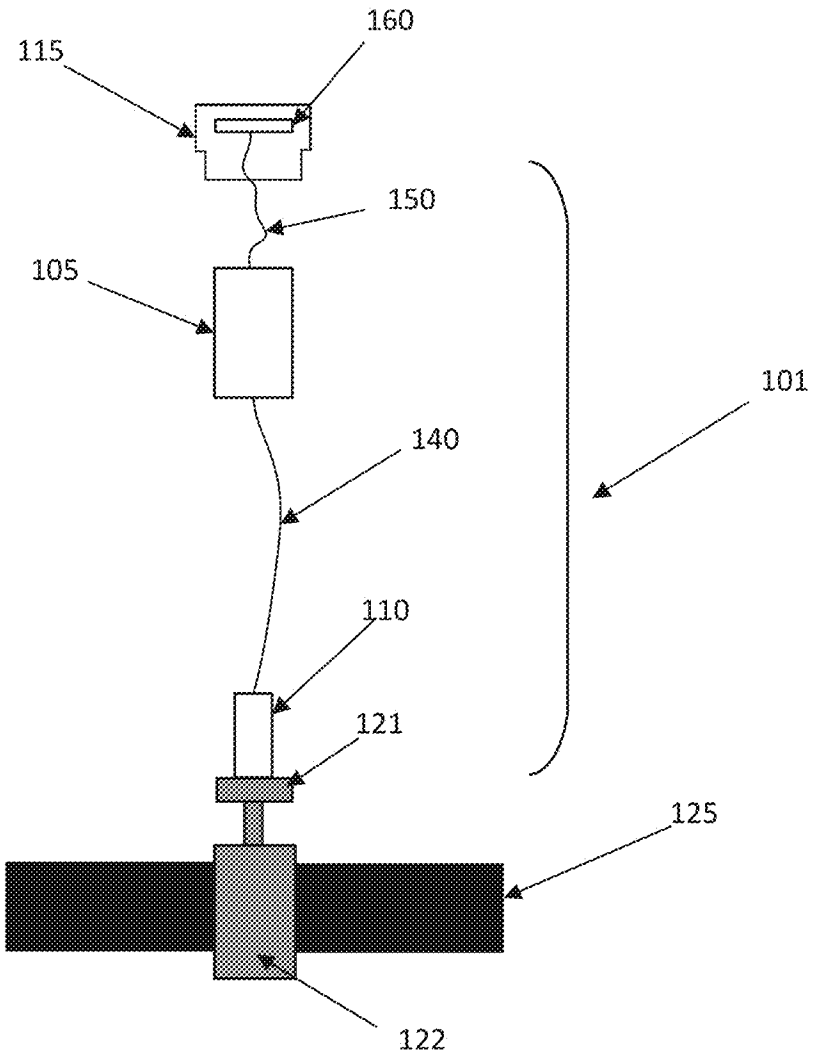
FIG. 2 is a diagram showing an exemplary communication assembly in accordance with one or more aspects of the present disclosure.

FIG. 2 is a detailed diagram providing a more detailed view of various exemplary components of communication assembly 101 of FIG. 1. As shown, acoustic sensor 110, which may also collect and log data over a predetermined length of time at certain intervals, is attached to the top of valve stem 121 of valve 122. In one exemplary embodiment valve 122 controls the flow of water through water main 125. Data cable 140 is connected between STU 105 and acoustic sensor 110 and provides a communication path for data and instructions to flow between these two units. Antenna cable 150 is connected between STU 105 and antenna 160, which is located within pit lid 115. Pit lid 115 is made of any suitable material, including non-metallic materials, such as plastic, as well as metallic materials, such as, cast iron or steel.

Figure 3:
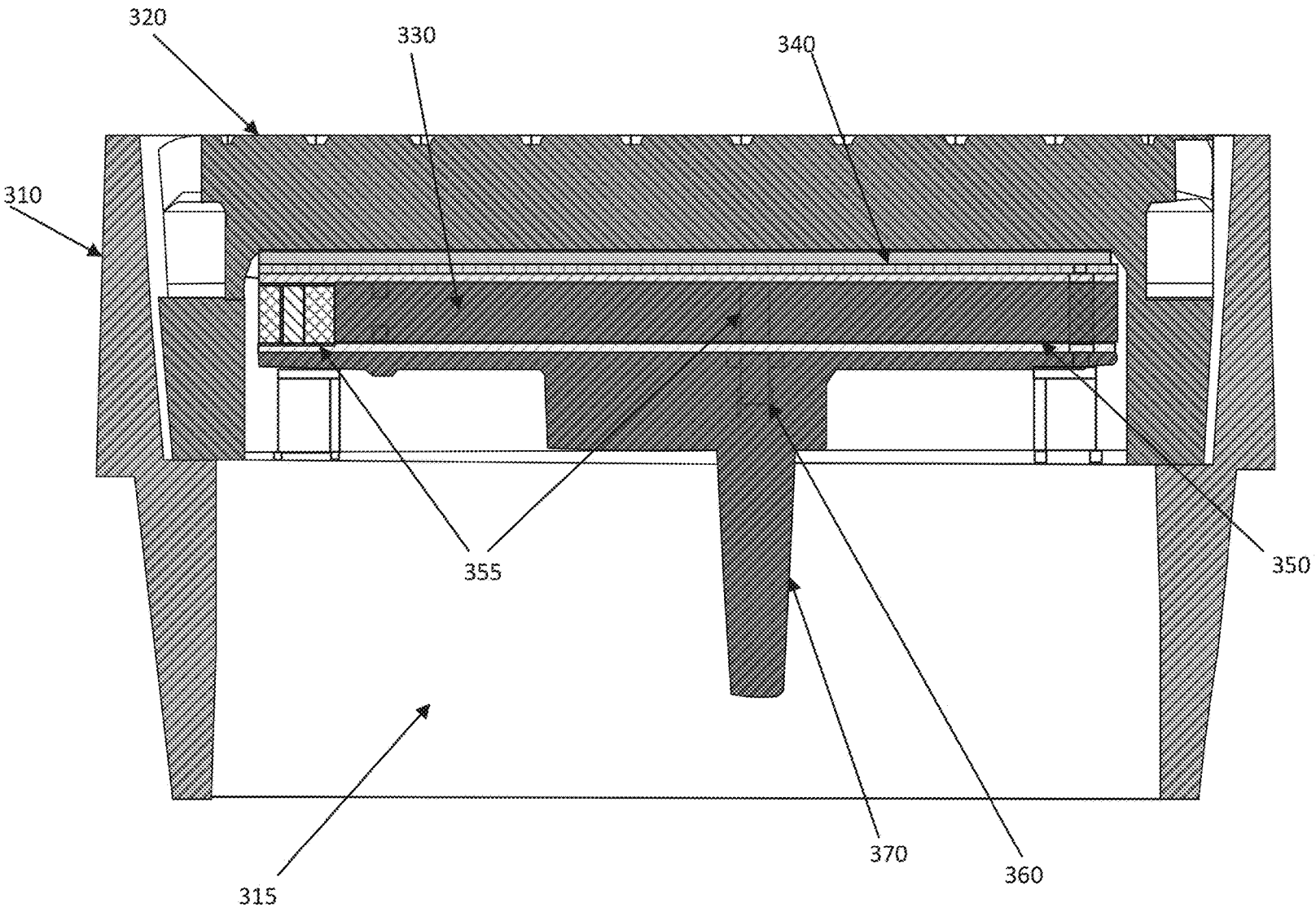
FIG. 3 is a cross sectional view of a pit lid in which an antenna arrangement in accordance with one or more aspects of the present disclosure is deployed.

FIG. 3 is a cross-sectional view of an exemplary pit lid, or valve cover 300, in accordance with at least one embodiment. As shown, pipe 310 includes an upper portion with an outer diameter and an inner diameter. Pipe 310 is made of steel, cast iron, PVC or other suitable material for providing protection from water or other foreign material entering the internal cavity 315. Further, according to one embodiment, pipe 310 encloses a valve chamber (such as valve chamber 120 of FIG. 1) where a water valve (not shown) is at one end of pipe 310 and pit lid 320 is disposed at an opposite end of pipe 310. In the illustrated embodiment pit lid 320 is made of plastic, or other non-reflecting material with respect to RF signals. Pit lid 320 provides a water tight seal to chamber 315 such that standing water atop pit lid 320 will not penetrate the pit lid into chamber 315.

In further reference to FIG. 3, antenna arrangement 330 resides immediately below pit lid 320. Thus, antenna arrangement 330 is disposed beneath the top of pipe 310 by a distance equal to at least the thickness of pit lid 320 and is protected from water and other contaminants existing external to chamber 315. A top surface of antenna arrangement 330 includes antenna pattern 340 and a lower surface includes a ground plane, both of which are described in more detail below. Antenna pattern 340 and ground plane 350 are separated by standoffs 355. Antenna feed point 360 connects antenna pattern layer 340 and ground layer 350 to a top portion of data connector 370. When antenna arrangement 330 is deployed in a water leak detection system, such as the water leak detection system illustrated in FIG. 1, a bottom portion of data connector 370 is communicatively connected to an antenna cable, such as antenna cable 150 in FIG. 1.

The antenna arrangement 330 may be configured to be resistant to water and/or other infiltrates. For example, the antenna arrangement 330 may be IP67 compliant (e.g., the antenna assembly 330 is protected from dust and is protected from the effects of being immersed in water to a depth between 15 cm and 10.0 meters for at least thirty minutes). Additionally, the antenna arrangement 330 may be configured to operate in temperatures from −40 degrees Celsius to +80 degrees Celsius and can radiate at least 2 miles. In one embodiment, the antenna arrangement is about 5.75 inches in diameter and can be mounted under and attached to a valve stack lid, such as pit lid 115 described above, in a water distribution network.

Figure 4A:
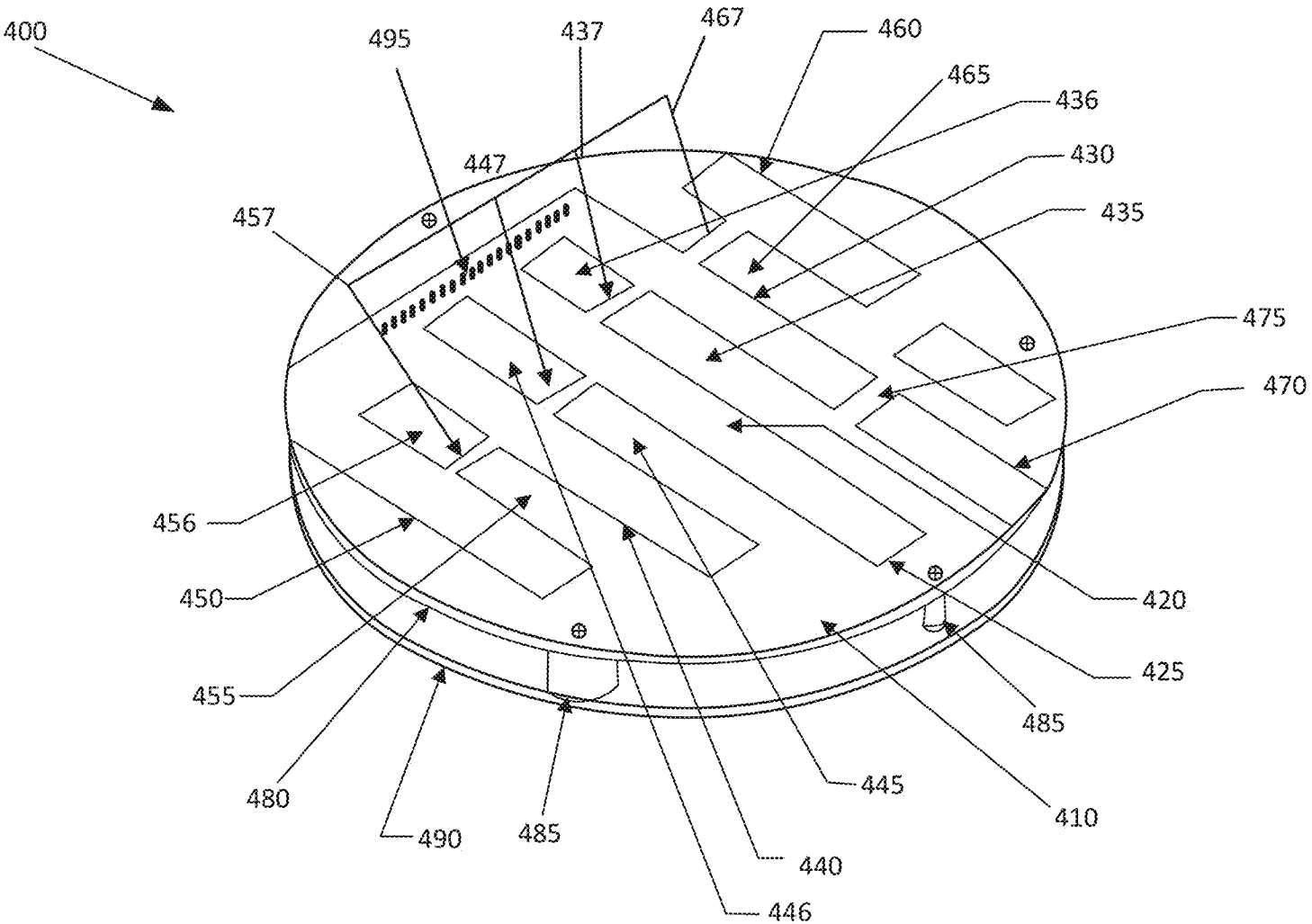
FIGS. 4A and 4B are top and bottom isometric views of an antenna arrangement in accordance with one or more embodiments of the present disclosure.

FIG. 4A is an isometric view of the top side of an antenna arrangement 400 in accordance with at least one embodiment of the present disclosure. For example, antenna arrangement 400 can be deployed as antenna arrangement 330 in FIG. 3. As shown in FIG. 4A, the top side of antenna arrangement 400 includes antenna pattern 410, which can be made of any suitable radiating material, such as copper, etc., and can be printed, etched, or formed by some other technique. As shown, antenna pattern 410 includes a feed point 420 located proximate the center of circular antenna pattern 410. Feed point 420 is electrically connected to driving element 425 and is further electrically connected to a data or signal source, such as data connector 370 of FIG. 3. Driving element 425 is an elongated rectangular conductive element positioned at approximately the center of antenna pattern 410. First and second conductive parasitic elements 430 and 440, respectively flank opposite side of driving element 425 and run parallel to driving element 425.

First parasitic gap 435 and first parasitic slot 436 separate a substantial portion of driving element 425 and first parasitic element 430, which runs parallel to, but is shorter than, driving element 425. Similarly, second parasitic gap 445 and second parasitic slot 446 separate a substantial portion of driving element 425 and second parasitic element 440, which is also parallel to and shorter than driving element 425. In fact, but for a relatively thin conductive first shorting bar 437, electrically connected between driving element 425 and first parasitic element 430 and defining first parasitic gap 435 adjacent one side thereof and first parasitic slot 436 on a second side thereof, the entire length of driving element 425 is separated from first parasitic element 430. Similarly, but for a relatively thin conductive second shorting bar 447, electrically connected between driving element 425 and second parasitic element 440 and defining second parasitic gap 445 adjacent one side thereof and second parasitic slot 446 on a second side thereof, the entire length of driving element 425 is separated from second parasitic element 440.

Conductive third parasitic element 450 is located on the opposite side of second parasitic element 440, i.e., the opposite side from driving element 425. Third parasitic element 450 runs parallel to but is shorter in length than second parasitic element 440. Third shorting bar 457 electrically connects second parasitic element 440 with third parasitic element 450 and defines non-conductive third parasitic gap 455 and third parasitic slot 456 on either side thereof.

Secondary band element 460 is an elongated conductive member running parallel to first parasitic element 430 and separated from first parasitic element 430 by a fifth parasitic gap 465. Fourth shorting bar 467 provides a thin electrical connection between first parasitic element 430 and secondary band element 460. A fourth conductive parasitic element 470, which is electrically separated from the other conductive parasitic elements and the driving element 425, is located adjacent a narrow side of first parasitic element 430 and separated therefrom by fourth parasitic gap 475. All conductive elements of antenna pattern 410 are formed on top of a substrate 480 and can be formed by such processes as etching or printing with conductive ink. Copper strips attached to the substrate can also be used to form the conductive parasitic elements and the driving element. Substrate 480 may be a dielectric substrate. The material of the substrate 480 may be a printed circuit board (PCB) made of a fiberglass reinforced epoxy resin (FR4), a Bismaleimide-triazine (BT) resin, sheet molding compound (SMC), or any other nonconductive or insulating material. In one embodiment, the substrate 480 is frequency stabilized over a desired range of output frequencies (such as 450 MHz-470 MHz).

According to one aspect of the embodiment illustrated in FIG. 4A, the parasitic elements each have different lengths, which causes a multi-resonance response to an input current signal received at the feed point 420. For example, with parasitic elements of differential length as shown, for example, in FIG. 5, multi-resonances are presented that allow for minimal return loss from an FCC-licensed frequency range of 450 MHz to 470 MHz. However, multi-resonant frequencies may extend as low as 430 MHz in some embodiments. The multi-resonances are close in frequency, which causes a wide bandwidth aggregate response.

Figure 4B:
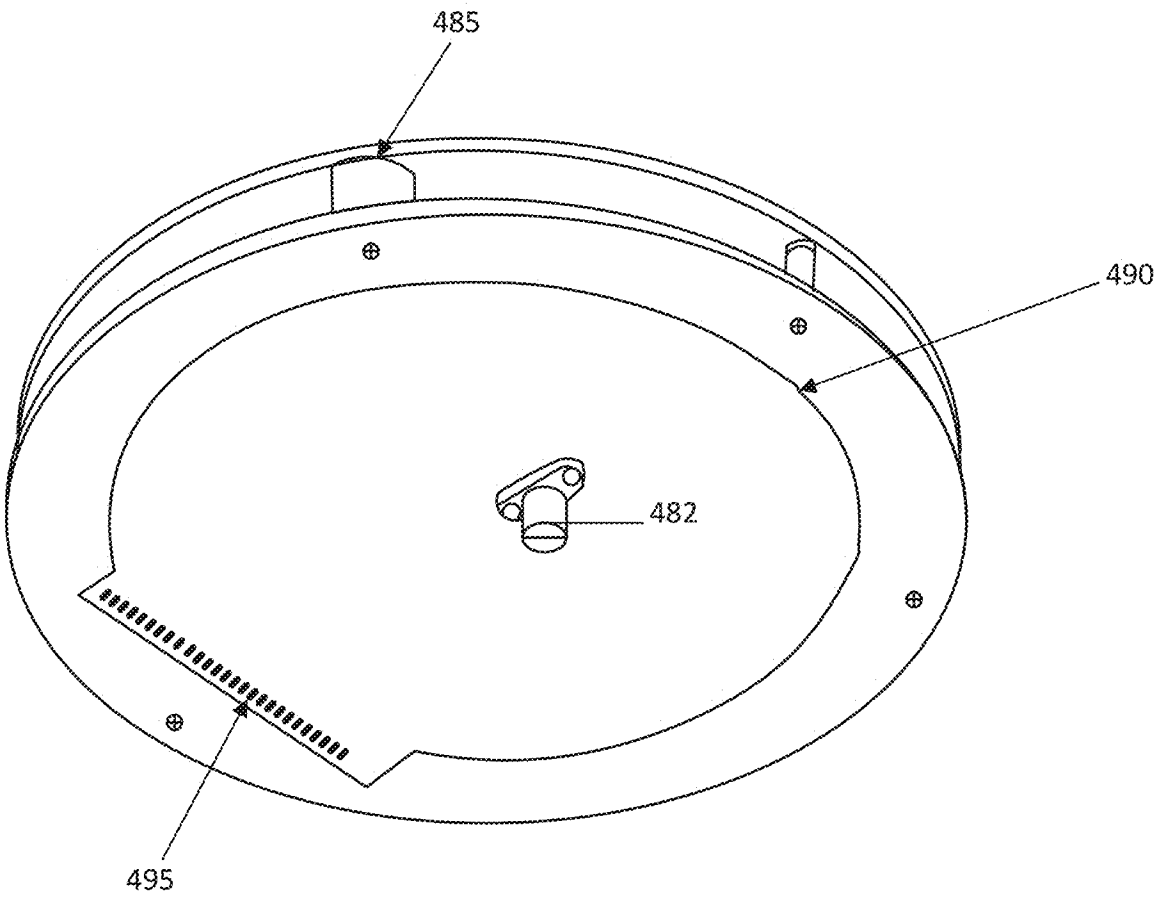

Referring to FIG. 4B, attached to the underside of the substrate 480 are a number of standoff elements 485 which separate antenna arrangement 410 from ground plane 490. Ground plane connector points 495 provide electrical connection between antenna arrangement 310 and ground plane 490 at the base of each, respectively. Feed through connector 482 is attached to the underside of ground plane 490 and provides a connection between feed point 420 on the antenna arrangement 410 and a drive signal, for example, antenna cable 150 from FIG. 2.

Figure 5:
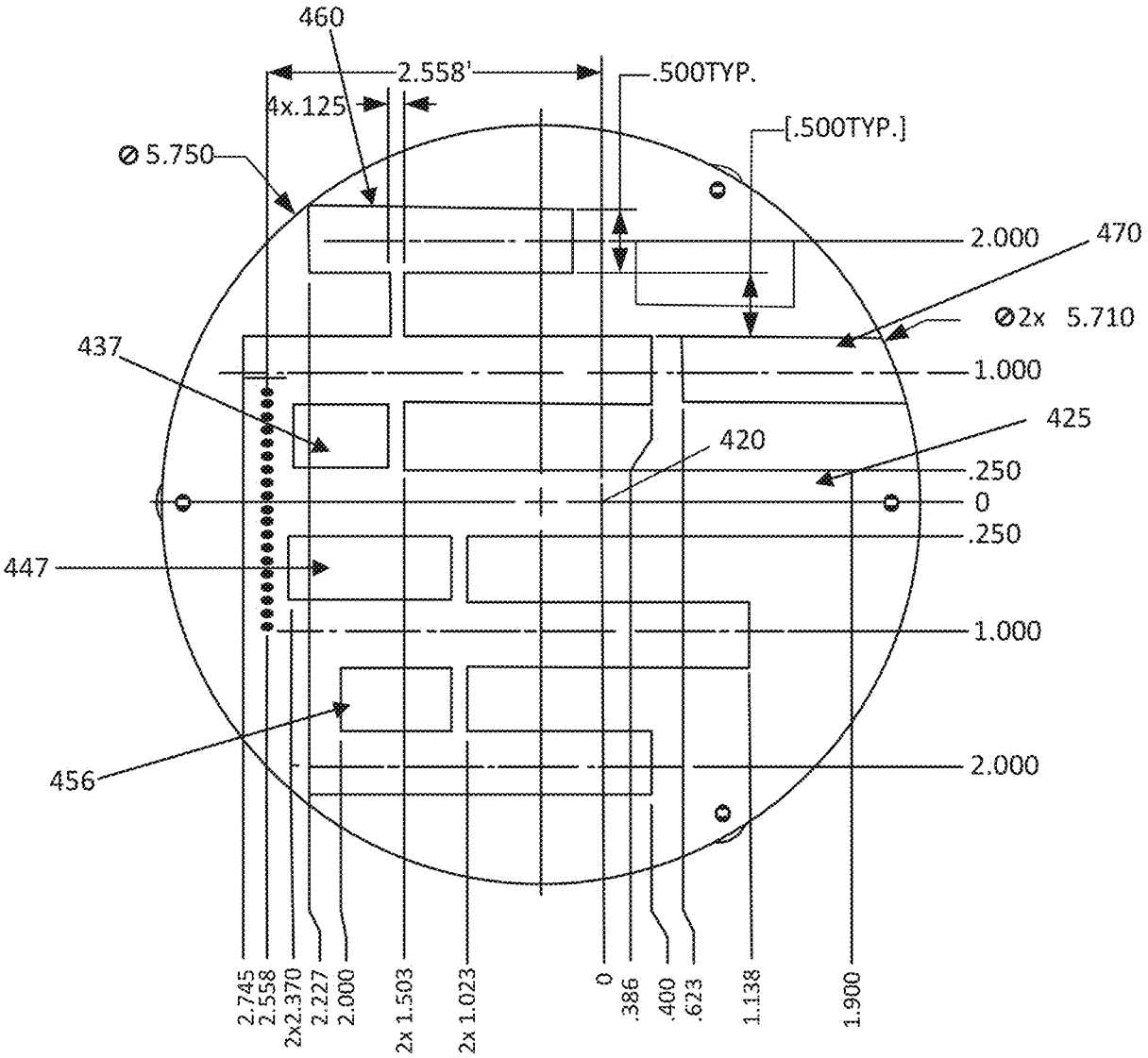
FIG. 5 is a top view of an antenna pattern in accordance with one or more exemplary embodiments showing representative dimensions for various antenna pattern elements.

FIG. 5 is a planar view of an antenna arrangement in accordance with one or more embodiments of the present disclosure. More particularly, FIG. 5 shows the dimensions of the antenna elements of the antenna arrangement described in reference to FIG. 4A above. For example, as shown, driving element 425 is centered on the circular substrate and has a length equal to approximately 1.9 inches relative to the drive or feed point 420, and is approximately 0.5 inches wide, i.e., 0.25 inches on either side of the center. Further, each parasitic element, gap and slot, is approximately 0.50 inches in width and has a unique length, which dictates the radiation properties of the antenna (described further below). Also, the conducting parasitic elements are each centered 1.0 or 2.0 inches from the center of driving element 425. For example, the second and third parasitic elements are positioned 1.0 and 2.0 inches, respectively, on one side of driving element 425 and the first parasitic element and the secondary band element are positioned 1.0 and 2.0 inches, respectively, on the opposite side of driving element 425. Further dimensions and relative locations of each of the antenna elements according to this embodiment of the disclosure are evident from a review of FIG. 5.

The shorting bars shown in FIG. 4A (e.g., 437, 447, 457 and 467) increase the overall bandwidth of the antenna arrangement. The respective lengths of the conductive elements (e.g., 425, 430, 440, 450 and 460) assist in dictating the overlapping resonance to achieve the overall desired wide bandwidth. According to the illustrated embodiment, the overall bandwidth is large enough to tolerate manufacturing variability and material inconstancies for the antenna arrangement.

According to one or more further exemplary embodiments, the connection between the conductive portions of the antenna pattern and the ground plane are centered between the first parasitic element (430) and the second parasitic element (440). Open parasitic slots, (e.g., 436, 446, 456) affect the overall tuning and bandwidth. Fourth parasitic element (470) affects the radiation pattern, e.g., provides for circular polarization of the radiated signal, and also affects overall tuning. In some embodiment, the polarization of the conductive elements (e.g., 425, 430, 440, 450 and 460) affects the radiation pattern to produce a circular polarization of the radiated signals. For example, the conductive elements may be a combination of horizontally polarized and vertically polarized in order to produce a circular polarization of the radiated signal. The combination of the elements, including the size of the ground plane and pipe (e.g., 310 in FIG. 3) contribute to a low radiation angle and pattern emanating from the antenna. For example, the pipe (e.g. 310 in FIG. 3) may impact the operation of the antenna, such as by providing a larger effective ground plane for the antenna. Size, type of material, depth in the ground, etc. can impact the affect of the pipe on the antenna. In one embodiment, the pattern emanating from the antenna is an orthogonal polarization pattern, which provides strong above ground radiation in all directions. Each of these parameters (e.g., number of elements, size, and position) can be adjusted for other frequencies as well. In some embodiments the antenna may be configured to transmit a radio frequency (RF) signal over relatively long distances, such as more than one mile.

Pit lid (e.g., 115 in FIGS. 1 and 2) has a loading effect on the antenna. Accordingly, in the configuration provided in various exemplary embodiments disclosed, the antenna pattern is tuned high or above the desired frequency range (450 MHz to 470 MHz) due to this loading effect. Moreover, this design can be adjusted for multiple bands and bandwidths.

The Abstract and Summary are provided to help the reader quickly ascertain the nature of the technical disclosure. They are submitted with the understanding that they will not be used to interpret or limit the scope or meaning of the claims. The summary is provided to introduce a selection of concepts in simplified form that are further described in the Detailed Description. The summary is not intended to identify key features or essential features of the claimed subject matter, nor is it intended to be used as an aid in determining the claimed subject matter.

When introducing elements of aspects of the invention or the embodiments thereof, the articles "a," "an," "the," and "said" are intended to mean that there are one or more of the elements. The terms "comprising," "including," and "having" are intended to be inclusive and mean that there may be additional elements other than the listed elements.

In view of the above, it will be seen that several advantages of the aspects of the invention are achieved and other advantageous results attained.

Not all of the depicted components illustrated or described may be required. In addition, some implementations and embodiments may include additional components. Variations in the arrangement and type of the components may be made without departing from the spirit or scope of the claims as set forth herein. Additional, different or fewer components may be provided and components may be combined. Alternatively or in addition, a component may be implemented by several components.

The above description illustrates the aspects of the invention by way of example and not by way of limitation. This description enables one skilled in the art to make and use the aspects of the invention, and describes several embodiments, adaptations, variations, alternatives and uses of the aspects of the invention. Additionally, it is to be understood that the aspects of the invention are not limited in their application to the details of construction and the arrangement of components set forth in the description or illustrated in the drawings. The aspects of the invention are capable of other embodiments and of being practiced or carried out in various ways. Also, it will be understood that the phraseology and terminology used herein is for the purpose of description and should not be regarded as limiting.

What is claimed is:

1. An antenna arrangement comprising:

a substrate;

a ground plane;

a driving element proximate to the substrate and electrically connected to the ground plane, the driving element including a feed point for receiving an input current signal;

a first parasitic element electrically connected to the driving element;

a second parasitic element longer than the first parasitic element and electrically connected to the driving element;

a third parasitic element shorter than the second parasitic element and electrically connected to the second parasitic element; and a fourth parasitic element shorter than the third parasitic element and electrically separated from the first, second and third parasitic elements.

2. The antenna arrangement of claim 1, wherein the first parasitic element is electrically connected to the driving element via a first shorting bar, the second parasitic element is electrically connected to the driving element via a second shorting bar, and the third parasitic element is electrically connected to the driving element via a third shorting bar.

3. The antenna arrangement of claim 1, wherein the third parasitic element is located on the opposite side of the driving element from the second parasitic element.

4. The antenna arrangement of claim 1, further comprising:

a non-conductive first parasitic gap disposed between the first parasitic element and the driving element;

a non-conductive second parasitic gap disposed between the second parasitic element and the driving element; and a non-conductive third parasitic gap disposed between the second parasitic element and the third parasitic element.

5. The antenna arrangement of claim 1, wherein an electromagnetic wave radiated from the antenna arrangement is circularly polarized.

6. The antenna arrangement of claim 1, wherein the first parasitic element and the second parasitic element are positioned on either side of the driving element.

7. The antenna arrangement of claim 1, wherein the first parasitic element and the second parasitic element are positioned parallel to the driving element.

8. The antenna arrangement of claim 1, wherein the antenna is configured to operate in temperatures in the range of −40° C. to 80° C.

9. The antenna arrangement of claim 1, wherein the antenna arrangement is configured to have a multi-resonant response from 450 MHz to 470 MHz.

10. A pit lid for providing a seal at a top of a valve chamber, comprising:

an antenna assembly including:

a ground plane, a substrate, and a driving element proximate the substrate and electrically connected to the ground plane, the driving element including a feed point for receiving an input current signal, wherein the substrate includes an antenna arrangement including a first parasitic element electrically connected to the driving element, a second parasitic element electrically connected to the driving element, a third parasitic element electrically connected to the driving element, and a fourth parasitic element electrically separated from the first, second, and third parasitic elements.

11. The pit lid of claim 10, wherein the antenna assembly is configured to receive a signal from a global positioning system (GPS) satellite.

12. The pit lid of claim 10, wherein the antenna arrangement is configured to have a multi-resonant response from 450 Megahertz (MHz) to 470 MHz.

13. The pit lid of claim 10, wherein the antenna arrangement further comprises:

a non-conductive first parasitic gap disposed between the first parasitic element and the driving element;

a non-conductive second parasitic gap disposed between the second parasitic element and the driving element; and a non-conductive third parasitic gap disposed between the second parasitic element and the third parasitic element.

14. The pit lid of claim 10, wherein an electromagnetic wave radiated from the antenna arrangement is circularly polarized.

15. The pit lid of claim 10, wherein the antenna arrangement and ground plane are separated by standoffs.

16. A communication system, comprising:

an antenna assembly;

a communication assembly comprising a sensor transmission unit communicatively connected to an acoustic sensor and the antenna assembly; and a pit lid, wherein the antenna assembly is mechanically coupled to the pit lid and positioned between the pit lid and a pipe;

wherein the acoustic sensor is physically coupled to a valve stem within a valve chamber.

17. The communication system of claim 16, wherein the pit lid is configured to provide a seal at a top of a valve chamber within the pipe.

18. The communication system of claim 16, wherein the communication assembly is configured to transmit data collected by the sensor to a remote data collection unit via the antenna assembly.

19. The communication system of claim 16, wherein the antenna assembly includes:

a substrate;

a ground plane;

a driving element proximate to the substrate and electrically connected to the ground plane, the driving element including a feed point for receiving an input current signal;

a first parasitic element electrically connected to the driving element;

a second parasitic element longer than the first parasitic element and electrically connected to the driving element;

a third parasitic element shorter than the second parasitic element and electrically connected to the second parasitic element; and a fourth parasitic element shorter than the third parasitic element and electrically separated from the first, second and third parasitic elements.

20. The communication system of claim 19, wherein the first, second, third, and fourth parasitic elements have different lengths from one another.

* * * * *